US006442882B1

(12) United States Patent
Dionne

(10) Patent No.: US 6,442,882 B1
(45) Date of Patent: Sep. 3, 2002

(54) CARTRIDGE EJECTION MECHANISM FOR CONVERTED AUTOMATIC PISTOL

(75) Inventor: Sylvain Dionne, Quebec (CA)

(73) Assignee: SNC Technologies Inc., Quebec (CA)

( * ) Notice: Subject to any disclaimer, the term of this patent is extended or adjusted under 35 U.S.C. 154(b) by 68 days.

(21) Appl. No.: 09/714,175

(22) Filed: Nov. 17, 2000

(30) Foreign Application Priority Data

Nov. 18, 1999 (CA) ..... 2290025

(51) Int. Cl.[7] ..... F41A 21/00

(52) U.S. Cl. ..... 42/77; 42/15; 89/29; 89/196; 89/163

(58) Field of Search ..... 42/77, 15, 39.5; 89/29, 194, 196, 163

(56) References Cited

U.S. PATENT DOCUMENTS 2,090,657 A * 8/1937 Williams ..... 42/75.02
3,724,326 A * 4/1973 Day ..... 42/49.02
5,675,106 A * 10/1997 Leiter ..... 42/7
5,983,773 A * 11/1999 Dionne ..... 42/77

* cited by examiner

*Primary Examiner*—J. Woodrow Eldred
(74) *Attorney, Agent, or Firm*—David J. French

(57) ABSTRACT

An automatic pistol converted to fire low energy ammunition in a blow-back mode has a replacement barrel that carries a cam on its upper surface. The weapon slide, as it retires during firing, contacts the cam and rotates the chamber end of the replacement barrel downwardly. This aligns the spent casing for ejection by the ejector, once extracted from the chamber. The slide may carry a removable deflector plate for contacting the cam.

7 Claims, 5 Drawing Sheets

FIGURE ID PRIOR ART

CARTRIDGE EJECTION MECHANISM FOR CONVERTED AUTOMATIC PISTOL

FIELD OF THE INVENTION

This invention relates to the field of firearms and provisions for modifying semi-automatic firearms for training purposes. In particular, it relates to reliable ejection of ammunition from firearms that have been modified to straight blow-back action so that they can fire low-energy ammunition.

BACKGROUND TO THE INVENTION

In military and police firearms applications almost all of the ammunition consumed is used for training. For some training purposes, however, normal ammunition is not adequate. An alternative type of known training ammunition, represented by U.S. Pat. No. 5,359,937 (adopted herein by reference), fires a low-mass projectile relying on a special, low-energy cartridge designed expand telescopically to provide cycling of suitably modified, recoil-operated automatic and semi-automatic weapons. This is effected by providing the cartridge with a sabot that is slidingly fitted into the cartridge casing.

An advantage of the low-energy training ammunition is that it has a shorter range and lower penetration capacity than standard ammunition. This permits use of smaller, less secure firing ranges as training facilities. If standard ammunition were accidentally employed in these facilities, unexpected dangers would arise from the increased striking power and range of standard ammunition.

The weapon modifications required to permit cycling while firing low-energy ammunition generally include replacing or modifying the barrel and sometimes replacing or adding certain other components, depending on the weapon involved. The low-energy cartridge represented by U.S. Pat. No. 5,359,937, in combination with a substitute training barrel, allows normal recoil and cartridge case ejection through a blow-back action.

When firing standard ammunition, with its abundant associated energy, it is necessary in many weapons, particularly pistols, to lock the barrel to the slide during the beginning of their rearward motion for a period of time long enough for the projectile to exit the barrel muzzle while the breech is still closed. This allows the chamber pressure to drop before the breech opens to extract and eject the spent cartridge case. A locking mechanism couples the slide and barrel together for the first portion of the recoil, and then releases the slide, usually with the aid of a cam. Thus, in such standard weapons, the barrel recoils, at least partially, with the slide. Upon unlocking, the slide continues its rearward travel while the barrel stops in the proper position to receive the next round from the magazine to be chambered by the slide as it returns to its in-battery position.

Associated with the barrel locking and unlocking action of the slide in a standard weapon, there may also be an up-and-down pivotal movement of the chamber end of the barrel. This pivoting motion may be caused by a cam located under the barrel. When in battery, the barrel is in its most upward position such that the center of the primer of the chambered round is aligned with the firing pin. After firing, the chamber end of the barrel drops to its most downward position, which brings it in line with the ejector.

In a training barrel it is necessary to omit this barrel locking mechanism and, by so doing, the recoil action becomes pure blow-back of the slide only. This must be done because there is not enough energy in low-energy training cartridges to precipitate sufficient recoil to unlock the barrel and the slide in their standard configurations. A training barrel of the type addressed by this invention is similar in most aspects to the standard barrel for a particular pistol with a barrel locking mechanism, but is modified, in part, by removing the locking mechanism, so that the barrel and the slide are no longer fully held together for the first portion of the recoil cycle. Thus, upon firing, the slide is free to move rearwards from its in-battery position unencumbered by the barrel.

In some converted pistols, after the mechanism for momentarily locking the barrel to the slide has been removed so that the weapon can fire low-energy ammunition, as represented by U.S. Pat. No. 5,359,037, the training barrel is restrained from longitudinal motion during the firing cycle. This is achieved by modifying the cam configuration such that the barrel is permanently attached to the pistol receiver (frame). By so doing, maximum energy is transferred to the slide, thereby contributing to reliable weapon cycling.

In some 9 mm pistols, after the locking mechanism has been removed so that the weapon can fire low-energy ammunition, an ejection problem may arise if the training barrel does not drop down or descend far enough during the recoil cycle to bring the expended training case into line with the ejector for extraction. Should this occur, the spent case may not come into proper contact with the ejector, thereby causing jamming due to failure to eject.

It is, therefore, an objective of this invention to provide an alternative training barrel system for this class of firearms that will ensure reliable ejection of the spent training cases.

The invention is applicable to pistols wherein it is necessary to retain an up-and-down movement of the chamber end of the training barrel even if the barrel is not able to move longitudinally. This is required so that the primer will be in line with the firing pin (most upward position of the barrel) when the weapon is in battery, and the expended case will be in line with the ejector (most downward position of the barrel) during the latter part of the recoil cycle. It is, therefore, another objective of this invention to ensure reliable ejection of spent training cases from training barrels which retain an up-and-down motion in pistols converted to fire low-energy ammunition.

Further, the concept of converting a pistol so that it can fire low-energy ammunition for training purposes is basically to replace the service barrel by a training barrel without modifying the slide or the receiver. In this way, the weapon can be rapidly reconverted to fire live ammunition again by removing the training barrel and reinstalling the service barrel. Other minor modifications may be necessary (e.g., to the recoil spring rod) but they, too, can be quickly reverted to their original configurations. It is, therefore, a third objective of this invention to provide a training barrel system for this class of training firearm that will allow quick and easy assembly/disassembly of the training barrel without modification to either the receiver or the slide.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

This invention is directed to an automatic pistol adapted to fire low-energy training ammunition by the substitution of a training barrel that omits the barrel-locking feature normally present, especially in combination with a barrel pivoting/cam system. Said substitution is effected without modification to either the receiver or the slide of the pistol being converted to fire training ammunition. The invention provides a system for orienting the spent cartridge case such that it will strike the ejector during the recoil cycle, thereby being knocked out of the weapon, while in no way affecting the alignment of the firing pin with the primer when the weapon is in battery (i.e., ready to fire).

According to the invention, a firearm preferably intended for use with a telescopically expanding cartridge, such as in U.S. Pat. No. 5,359,937 is provided with a training barrel and a standard service slide which has an ejection port with a forward vertical face. The training barrel and service slide are at no time locked together and the training barrel is restrained from longitudinal movement, but free to move up and down at its chamber end. The firearm into which this training barrel is to be installed has an ejector member located within the firearm frame rearwardly of the barrel at a position that is beneath the geometric extension of a cartridge chambered in the barrel when in the in-battery position.

The training barrel of the invention is similar to a standard barrel in that it includes a bore with a chamber; but differs from a standard barrel in that:

(1) the normal cam configuration below the chamber is removed to eliminate interaction with the frame, as described above; and (2) a cam surface is added to the top of the barrel above the chamber to induce an up-and-down motion of the chamber end of the barrel as the slide moves over it.

This cam surface is contacted by the overlying slide on firing in order to effect the required downward displacement.

When in battery, the cam surface of the training barrel above the chamber is located in the ejection port of the slide where its forward end abuts the forward vertical face of the ejection port. When the slide recoils after firing under the impetus of the telescopically expanding cartridge, it passes over the cam surface of the training barrel, thereby forcing said training barrel downwards to the extent of the design of said cam surface. Preferably, the forward edge of the ejection port may be chosen to bear against the barrel's camming surface, but another portion of the slide may effect this function.

The forward vertical face of the ejection port, however, tends to wear after only a relatively few impacts with the longitudinally immobile cam surface of the training barrel, thereby retarding downward movement of said training barrel and compromising reliable ejection. In addition, this worn surface would make the slide unusable when firing standard service ammunition, and hence would constitute a modification to the slide, which is not permitted.

To counter this deficiency, a deflection plate may be inserted over the vertical face at the forward end of the ejection port. This deflection plate, which is of sufficient strength to resist repeated impacts from the cam surface of the training barrel without wear, is designed in conjunction with said cam surface to ensure that the most downward position of the training barrel is always in line with the ejector. Thus, a spent training case, upon exiting the chamber of the training barrel when said training barrel is at its most downward position, will strike the ejector and be thrown through ejection port in the slide in a positive, reliable and normal manner.

More particularly, the invention is directed to an automatic pistol having:

(a) a frame;

(b) a slide mounted on the frame, said slide having an ejection port formed therein; and (c) a training barrel with chamber and muzzle ends carried by the frame and having an upper surface that carries a camming face that is aligned with a portion of the slide wherein the slide, in effecting rearward sliding displacement with respect to the frame during firing, passes over and bears against the camming face on the barrel, deflecting the chamber end of the barrel downwardly.

The foregoing summarizes the principal features of the invention and some of its optional aspects. The invention may be further understood by the description of the preferred embodiments, in conjunction with the drawings, which now follow.

SUMMARY OF THE FIGURES

FIG. 1D is an enlarged detail of the engagement of the slide with a barrel in a service pistol.

DESCRIPTION OF THE PREFERRED EMBODIMENT

Figure 1A:
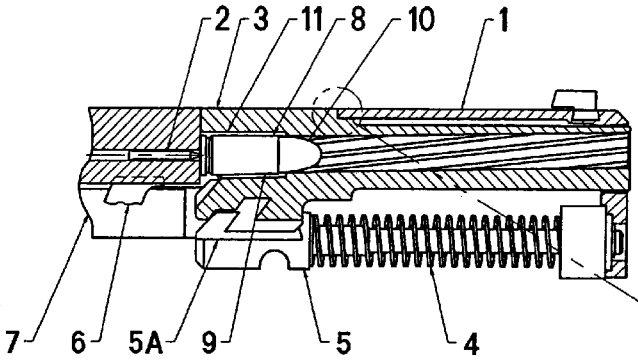
FIGURE 1A PRIOR ART
FIG. 1A is a partial cross-section of a prior art service pistol showing the slide, barrel, recoil spring assembly and ejector with a service cartridge chambered in the in-battery position.

In FIG. 1A a standard slide 1 with firing pin 2, service barrel 3, service recoil spring assembly 4 (containing service recoil rod 5 with service cam 5A), and ejector 6 are mounted in a 9 mm standard frame 7 (only partially depicted) with a fully-chambered service cartridge 8, containing service case 9 and service projectile 10, in service chamber 11. As shown in FIG. 1A the weapon is in the in-battery position.

After the weapon is fired, slide 1 commences its recoil cycle and service barrel 3 initially moves rearwardly with the slide 1. The forward vertical face 12A of the ejection port 12 engages with the service barrel vertical face 3A for this purpose—cf FIG. 1D. The spent case 9 continues to move rearward out of service chamber 11 with the aid of an extractor (not shown) that is carried by the slide 1. As service barrel 3 moves rearwardly it also moves slightly downward within cam 5A, disengaging the barrel 3 from the slide 1.

Figure 1B:
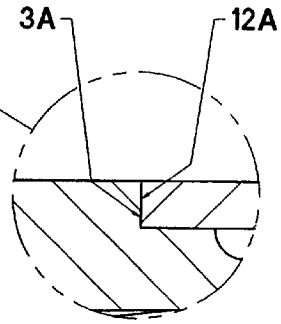
FIGURE 1B PRIOR ART
FIG. 1B is the same view as in FIG. 1A, but showing the relative positions of the components after firing just before the spent cartridge case engages the ejector.
Figure 1B:
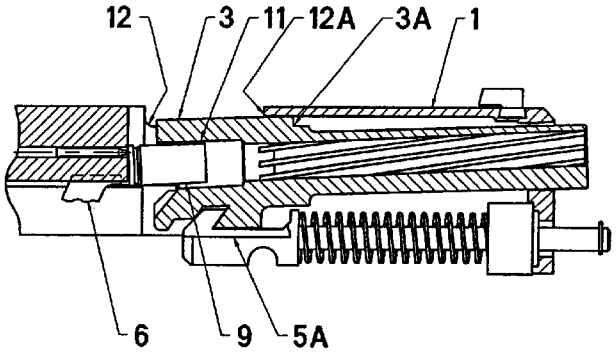
FIGURE 1B PRIOR ART

In FIG. 1B service barrel 3 is at its most downwardly angled position as it is arrested by the travel limit of service cam 5A. This downwardly oriented alignment ensures that spent service case 9 will engage ejector 6 as it is extracted from service chamber 11 by the slide 1. Spent case 9 is shown in FIG. 1B just before it engages ejector 6.

Figure 1C:
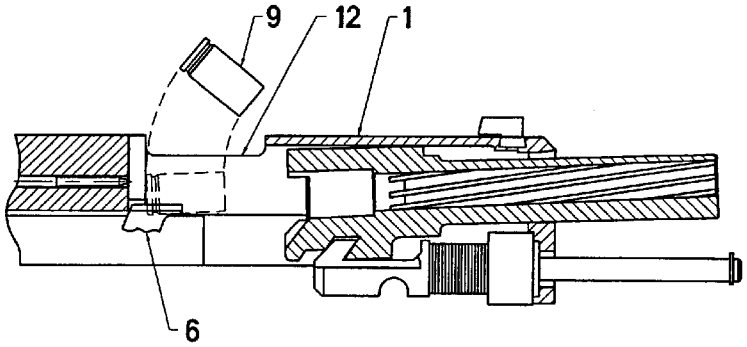
FIGURE 1C PRIOR ART
FIG. 1C is the same view as FIGS. 1A and 1B, but showing the components at the full recoil position with the spent case being ejected from the weapon through the ejection port in the slide.

There is in these prior art actions little or no impact of forward vertical face 12A of ejection port 12 on service barrel vertical face 3A because service barrel 3 drops downward immediately upon firing as guided by service cam 5A. In FIG. 1C slide 1 is at the full extent of its recoil and spent service case 9, after engaging ejector 6, has been ejected from the weapon through ejection port 12.

In the converted weapon of FIGS. 2A–2D the same 9 mm slide 1, replacement training barrel 13, training recoil spring assembly 14 and normal ejector 6 are mounted in the same 9 mm standard frame. A fully-chambered low-energy training cartridge 15, as represented by U.S. Pat. No. No. 5,359,937, containing training case 16 and training projectile 17, in training chamber 18 is shown as being present.

When the weapon is fired, training barrel 13 does not move rearwardly with the slide 1. This is because the training cartridge 16 case expands telescopically (as in FIG. 2C, thrusting the slide 1 and training barrel 13 apart. Significant longitudinal movement of said barrel 13 does not occur, but vertical up-and-down motion of said barrel 13 is not impeded. Since there is no longer a pivoting cam 5A to guide training barrel 13 downwards (see FIGS. 1A and 1B), training cam surface 19 has been added to the top of training barrel 13 above training chamber 18 to guide said barrel 13 downwards as vertical forward face 12A of ejection port 12 of slide 1 passes over it. Immediately upon firing slide 1 recoils causing vertical forward face 12A of said slide 1 to interact with training cam surface 19 of training barrel 13, thereby forcing said barrel 13 downwards. As the slide 1 retires it withdraws the spent casing 16 with it. Cam surface 19 is so designed as to lower training barrel 13 to a position where spent training case 16 will engage ejector 6 as it is extracted from training chamber 18. This is illustrated in FIG. 2C, which shows said spent case 16 just before it reaches ejector 6. In FIG. 2D slide 1 is at the full extent of its recoil and spent training case 16, after engaging ejector 6, has been ejected from the weapon through ejection port 12.

Figure 2A:
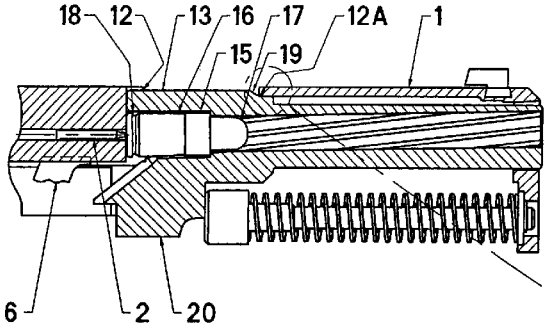
FIG. 2A is a partial cross-section of a service pistol modified to fire low-energy, telescopically expanding training ammunition showing a regular service slide, new training barrel, training recoil spring assembly and the regular service ejector with a low-energy training cartridge chambered in the in-battery position.
Figure 2B:
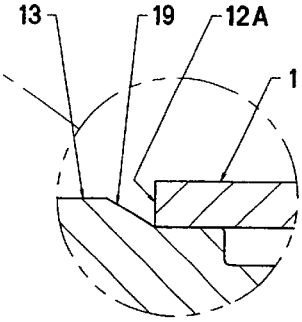
FIG. 2B shows an enlargement of that portion of FIG. 2A which depicts the interface between the cam surface above the chamber of the training barrel and the forward face of the ejection port of the slide.
Figure 2C:
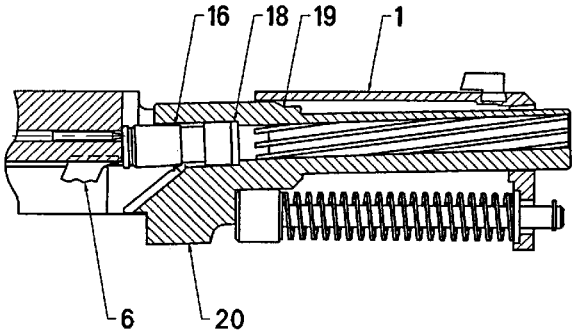
FIG. 2C is the same view as in FIG. 2A, but showing the relative positions of the components after firing just before the spent training cartridge case engages the service ejector.
Figure 2D:
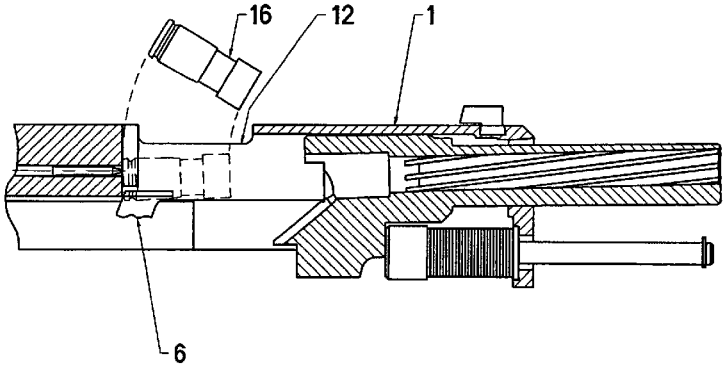
FIG. 2D is the same view as FIGS. 2A and 2C, but showing the components at the full recoil position with the spent training case being ejected from the weapon through the ejection port in the service slide.
Figure 3A:
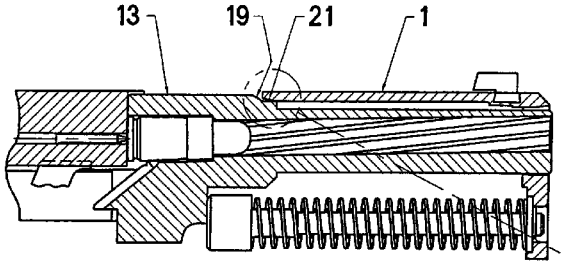
FIG. 3A is the same view as FIG. 2A except that the forward face of the ejection port in the slide has been worn from repeated firings.
Figure 3B:
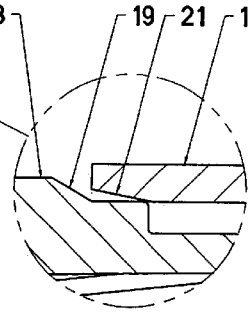
FIG. 3B shows an enlargement of that portion of FIG. 3A which depicts the interface between the cam surface above the chamber of the training barrel and the worn forward face of the ejection port of the slide.

Unfortunately, however, the performance described in FIGS. 2A, 2B, 2C and 2D cannot be sustained for more than a few firings because the impact of the lower edge of the vertical forward face 12A of slide 1 on cam surface 19 quickly wears the face 12A. This is illustrated in FIGS. 3A and 3B. Appreciable wear of vertical forward face 12A occurs after as few as a hundred rounds of low-energy training cartridge 15 have been fired. FIG. 3A is essentially identical to FIG. 2A except that it shows the vertical forward face 12A badly worn, hence transformed into worn forward face 21 of ejection port 12 of slide 1. Enlarged detail, similar to FIG. 2B, is provided in FIG. 3B.

Figure 3C:
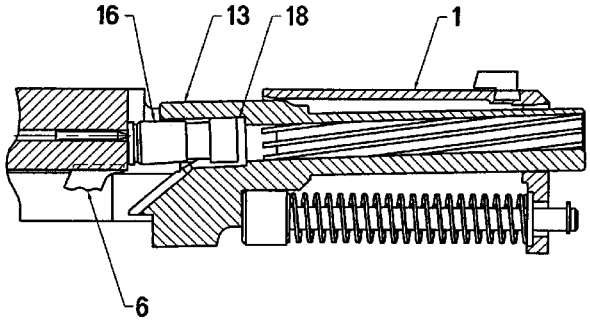
FIG. 3C is the same view as FIG. 3A, but showing the relative positions of the components after firing just before the spent training cartridge case reaches the service ejector.
Figure 3D:
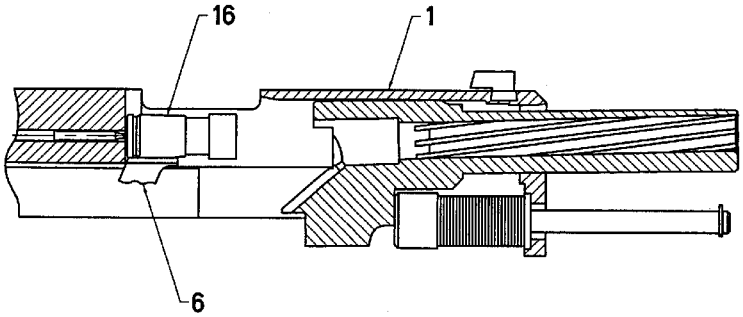
FIG. 3D is the same view as FIGS. 3A and 3C, but showing the components at the full recoil position with the spent training case passing over the top of the ejector, not being ejected and remaining in the weapon.

The result of having a worn forward face 21 on the forward edge of ejection port 12, instead of a vertical forward face 12A, is that the training barrel 13 ceases to reach a fully downward position. Further, the extraction of spent training case 16 from training chamber 18 may be completed before said case 16 is in line with extractor 6. This situation is depicted in FIG. 3C, which shows spent training case 16 being out of line with ejector 6 just before it reaches ejector 6. In FIG. 3D slide 1 is at the full extent of its recoil and spent training case 16, after passing over ejector 6, has not been ejected from the weapon. Under these circumstances, the weapon will jam when slide 1 commences to return towards the in-battery position.

Figure 4:
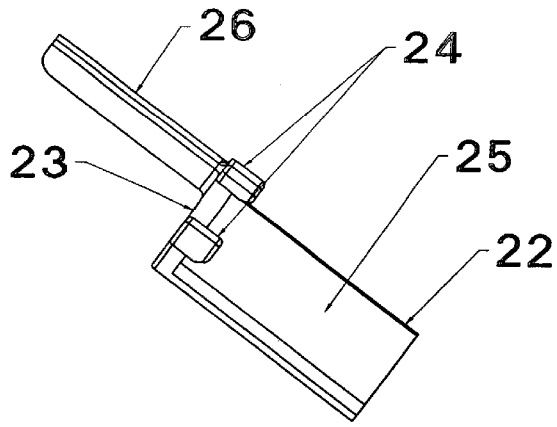
FIG. 4 is an illustration of a deflector plate.

To resolve the double problem of damaging slide 1, hence rendering it useless for both training and service use, and the unreliability of ejecting spent training case 16 as forward face 21 of ejection port 12 of slide 1 becomes worn, the invention includes insertion of a removably attached deflector plate 22, shown in FIG. 4. Forward face 23 of defector plate 22 is made of material sufficiently strong so as to resist wear when struck repeatedly by the training cam.

Figure 5A:
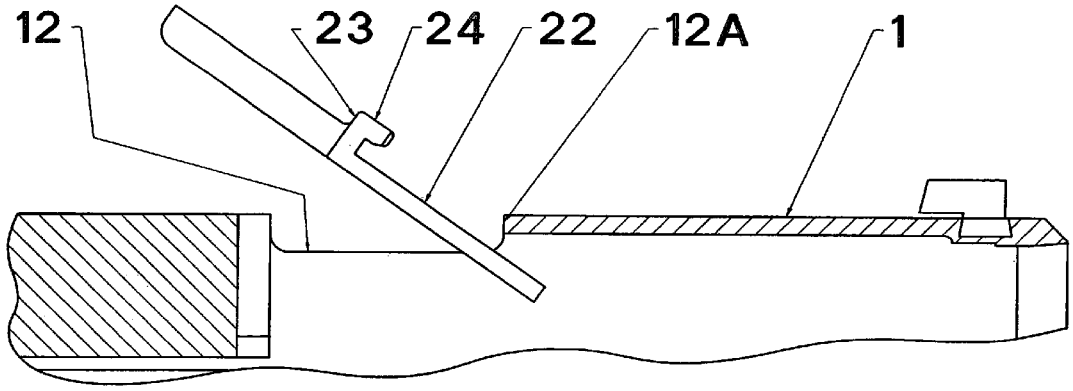
FIG. 5A shows the deflector plate being inserted into a service slide through its ejection port.
Figure 5B:
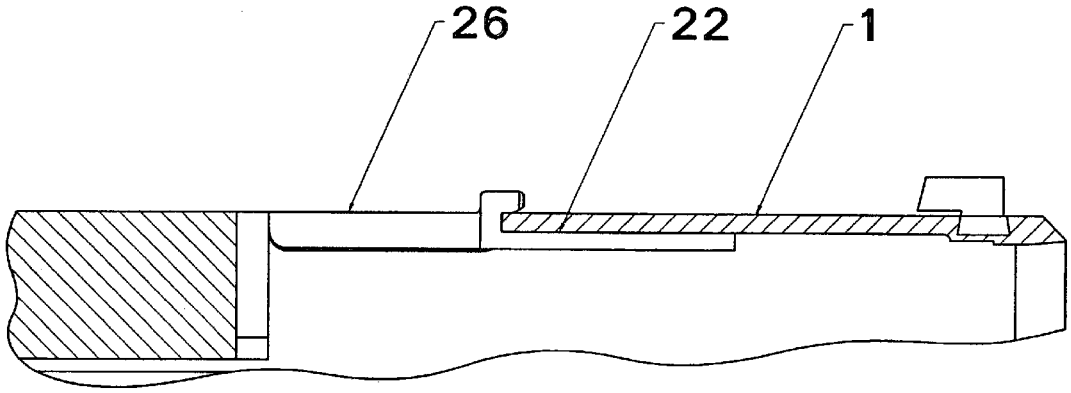
FIG. 5B shows the deflector plate fully positioned in the service slide.

The defector plate 22, comprising a forward face 23, fits over vertical forward face 12A of ejection port 12 of slide 1 to protect it from wear during firing. Positioning of deflector plate 22 over said vertical forward face 12A of ejection port 12 is illustrated in FIGS. 5A and 5B. The deflector plate 22 is positioned manually through ejection port 12 and held in place over vertical forward face 12A by attachment hooks 24, support surface 25 and guide arm 26 which nests in the ejection port 12.

Figure 6A:
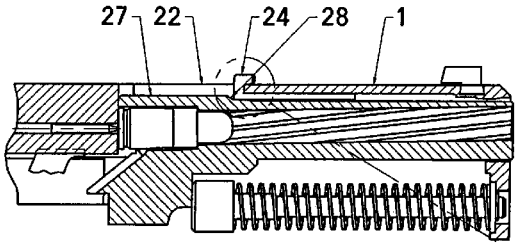
FIG. 6A is a partial cross-section of a service pistol modified to fire low-energy training ammunition showing a service slide with deflector plate, training barrel, training recoil spring assembly and service ejector with a low-energy training cartridge chambered in the in-battery position.

FIG. 6A is identical to FIG. 2A except that deflector plate 22 has been added to slide 1. This, however, means that training barrel 3 and training cam surface 19 must be adjusted to fit with deflector plate 22. They have, therefore, been replaced respectively by modified training barrel 27 and modified training cam surface 28 such that there is room for deflector plate 22 to be present, cf FIG. 6D. Forward face

Figure 6B:
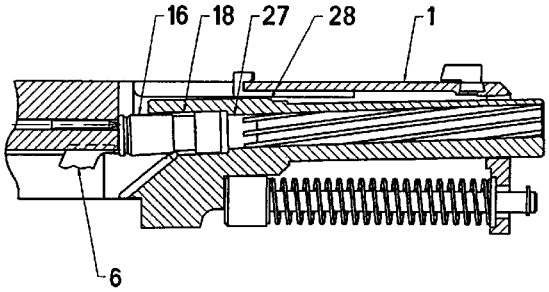
FIG. 6B is the same view as in FIG. 6A, but showing the relative positions of the components after firing just before the spent training cartridge case engages the service ejector.
Figure 6C:
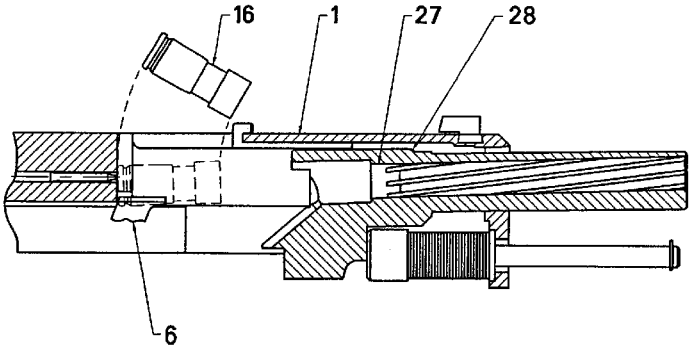
FIG. 6C is the same view as FIGS. 6A and 6B, but showing the components at the full recoil position with the spent training case being ejected from the weapon through the ejection port in the service slide.
Figure 6D:
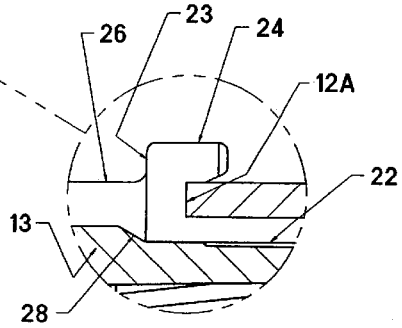
FIG. 6D is an enlarged detail of the engagement of a wear-plate protected slide with a training barrel.

23 of deflector plate 22 must resist wearing from being repeatedly struck against cam surface 28 being struck repeatedly by training cam surface 28. The object is to ensure that the modified training barrel 27 will be lowered, upon firing, to a position where spent training case 16 will engage ejector 6 as it is extracted from training chamber 18. This is illustrated in FIG. 6B, which shows said spent case 16 just before it reaches ejector 6. In FIG. 6C slide 1 is at the full extent of its recoil and spent training case 16, after engaging ejector 6, has been ejected from the weapon through ejection port 12.

The functioning of the subject deflector plate ejection mechanism has been tested many hundreds of times in H&K USP pistols with complete success and reliability. While this deflector plate ejection mechanism is particularly suited for the training barrel for the H&K USP pistol, it is also suited to training barrels destined for the Glock 17, Glock 22 and Walther P99 weapons as well as other automatic firearms that fire low-energy ammunition as represented by U.S. Pat. No. 5,359,937 or any other type of low-energy ammunition, including blanks, that require guidance during extraction to ensure ejection.

While this disclosure has elaborated the invention for purposes of training with low-energy ammunition, the invention is also suited for the firing of low-energy ammunition for such other purposes as the marking of animate or inanimate objects (e.g., trees or animals), or for crowd control and other like uses.

CONCLUSION

The foregoing constitutes a description of specific embodiments showing how the invention may be applied and put into use. These embodiments are only exemplary. The invention in its broadest and more specific aspects is further described and defined in the claims which follow. These claims, and the language used therein, are to be understood in terms of the variants of the invention which has been described. They are not to be restricted to such variants, but are to be read as covering the full scope of the invention as is implicit within the invention and the disclosure that has been provided herein.

The embodiments of the invention in which an exclusive property are claimed are as follows:

1. An automatic pistol having:

(a) a frame;

(b) a slide mounted on the frame, said slide having an ejection port formed therein; and (c) a training barrel with chamber and muzzle ends carried by the frame and having an upper surface that carries a camming face that is aligned with a portion of the slide wherein the slide, in effecting rearward sliding displacement with respect to the frame during firing, passes over and bears against the camming face on the barrel, deflecting the chamber end of the barrel downwardly.

2. A pistol as in claim 1 wherein the ejection port is defined at its forward end by an edge carried by the slide and said edge bears against the camming face on the barrel.

3. The pistol of claim 1 wherein the slide provides an edge adjacent to the forward end of the ejection port and said pistol further comprises a deflector plate that is removably installed between said edge on the slide and the camming face on the barrel.

4. A pistol as in claim 3 wherein the deflector plate comprises a guide arm which nests within the ejection port of the slide when the defector plate is installed on the slide at the forward end of the ejection port.

5. A pistol as in claim 4 having hook means for engaging the edge of the slide at the forward end of the ejection port.

6. A pistol as in claim 1 in combination with a cartridge installed in the chamber end of the training barrel whereby said cartridge, upon firing, imports a blow-back action to said slide.

7. A pistol as in claim 6 wherein said cartridge is a telescopically expanding cartridge.

* * * * *